United States Patent [19]

Björklund

[11] Patent Number: 4,671,422

[45] Date of Patent: Jun. 9, 1987

[54] ASSEMBLEABLE BOX

[76] Inventor: Evert G. Björklund, Tallbacka, 730 73 Ransta, Sweden

[21] Appl. No.: 850,085

[22] Filed: Apr. 9, 1986

Related U.S. Application Data

[63] Continuation of Ser. No. 665,387, Oct. 24, 1984, abandoned.

[30] Foreign Application Priority Data

Nov. 9, 1983 [SE] Sweden ..... 8306155

[51] Int. Cl.[4] ..... B65D 6/24; B65D 6/26

[52] U.S. Cl. ..... 220/4 F; 217/12 R; 217/65; 217/69; 220/80

[58] Field of Search ..... 220/4 F, 80, 7 R; 217/65, 69, 66, 12 R; 52/285, 584, 585

[56] References Cited

U.S. PATENT DOCUMENTS

| | | | |
|---|---|---|---|
| 1,737,186 | 11/1929 | Champlin | 217/12 R |
| 2,801,761 | 8/1957 | Pigatti et al. | 217/12 R |
| 2,896,808 | 7/1959 | Papy et al. | 217/69 X |
| 3,047,183 | 7/1962 | Papa | 220/4 F |
| 3,144,951 | 8/1964 | Knabf | 217/65 |
| 3,246,787 | 4/1966 | Bell et al. | 217/65 X |
| 3,403,641 | 10/1968 | Baker | 217/65 X |
| 3,477,604 | 11/1969 | Kridle | 217/12 R |
| 3,673,638 | 7/1972 | Nordgren | 217/12 A X |
| 3,990,599 | 11/1976 | Rowley | 217/12 R |

FOREIGN PATENT DOCUMENTS

| | | | |
|---|---|---|---|
| 450693 | 9/1927 | Fed. Rep. of Germany | 217/65 |
| 911753 | 7/1946 | France | 217/65 |
| 517341 | 2/1955 | Italy | 217/12 R |
| 536108 | 11/1955 | Italy | 217/69 |
| 407961 | 3/1934 | United Kingdom | 217/69 |
| 510660 | 8/1939 | United Kingdom | 217/12 R |
| 513675 | 10/1939 | United Kingdom | 220/4 F |

*Primary Examiner*—Allan N. Shoap

*Attorney, Agent, or Firm*—Burns, Doane, Swecker & Mathis

[57] ABSTRACT

Method of manufacturing a box and an arrangement permitting the secure but separable connection of an edge part of a first component to an adjacent edge part of a second component. Each edge part is provided with a number of connecting portions designed to produce the connection. The connecting portions for one of the edge parts and the connecting portions for the other edge part are so poritioned with respect to each other as to include, irrespective of their directional orientation lengthwise along the respective edge part, connecting portions which correspond to each other for interacting with one another.

4 Claims, 9 Drawing Figures

IV
V

ASSEMBLEABLE BOX

This application is a continuation of application Ser. No. 665,387, filed Oct. 24, 1984, now abandoned.

TECHNICAL FIELD

The present invention relates to a method of manufacturing a box having a number of components which may be interconnected. An edge part of one component is connected to an edge part of an adjacent component, and the connection is made by securing means attached to each edge part arranged to produce the connection. Each component has dimensions corresponding to a desired box volume. Each edge part interacts in a secure but separable fashion with an adjacent edge part and includes a number of securing means for producing the connection.

The invention also pertains to an arrangement for permitting a secure but separable connection to a second component in which each edge part is provided with a number of the securing means for producing the connection.

BACKGROUND OF THE INVENTION

German Offenlegungsschrift No. 21 02 033 discloses the application of a first edge part of a metal strip bent to an angle and provided with a number of slots of identical length and width, and having a fixed separation distance between adjacent slots. Metal flaps having a width slightly less than the width of each slot are applied to a second edge part. Thus, when one component is to be brought into interaction with the other component, the flap must be introduced into the corresponding slot, whereupon the flap is bent through 180° about a part of the strip, thereby producing a secure but separable connection between the edge parts.

A number of other methods and arrangements for manufacturing boxes utilize metal strips as the securing means.

It has been found to be particularly advantageous to form all the components of the box, the side components, the base and/or the lid from plywood, in which case the edge parts are reinforced by the angled metal strips. The metal strips also serve to provide the connection between adjacent edge parts.

DESCRIPTION OF THE PRESENT INVENTION

Technical Problem

The application of the previously disclosed method for the manufacture of a box involves ensuring an accurate fit between the slots in the metal strip applied to one edge part and the flaps attached to the adjacent edge part. As a result of these manufacturing requirements, the previously disclosed method of manufacturing boxes will offer particular advantages only in conjunction with the manufacture of a very large number of standardized boxes, since difficult setting-up operations will have to be peformed on the machines which are to apply metal strips to one edge part and which are to apply flaps to an adjacent edge part in a precise position in relation to the slots in the metal strip.

Therefore, an object of the present invention is to provide a method for manufacturing boxes in which the boxes are manufactured both in the form of standardized boxes and in the form of special boxes, usually in smaller numbers than the standardized boxes, without having to change the settings of the machines on the production line.

Another object of the invention is to provide a box having connecting means for a first edge part that are capable of being secured irrespective of the direction or position of the connecting means for a second, adjacent edge part, such that the connecting means for the second, adjacent edge part are also capable of being secured irrespective of the direction or position of the connecting means for the first edge part by providing a plurality of raised portions defining the length of the securing means for the first part and a corresponding raised portion defining the securing means of the second part so that the holding means is receivable in the securing means of the first and second parts.

Another object of the invention is to provide a box having a strip of a kind which includes a number of first securing means arranged one after the other, such that the strip is capable of being secured to an edge part without being fitted to corresponding securing means, and other securing means which are separate from the first securing means of the first strip are capable of being secured to an adjacent edge part without being fitted to corresponding securing means, such that the securing means may be arranged in the form of projections or slots which are arranged to permit a separate connecting organ to connect together corresponding securing means.

Still another object of the invention is to provide a box having securing means which on the one hand provide for a box having great strength relative to the manufacturing cost of the box, yet on the other hand are themselves inexpensive to manufacture and to attach to the component parts of the box.

Still yet another object of the invention is to provide a box in which corresponding connecting means can be selected at will in relation to the anticipated weight of the contents of the box and in relation to the anticipated size of the contents.

Yet another object of the invention is to provide a box in which a continuous strip having securing means formed thereon may be economically manufactured and utilized.

Another object of the invention is to provide a method for the manufacture of a box capable of being folded up, in which the connecting means for producing the connection between adjacent edge parts are fully protected by the component parts of the box, in this way enabling previously projecting flaps to be eliminated during storage.

Still another object of the invention is to provide a box having securing means that will permit corresponding securing means to be brought in a simple fashion into engagement with each other, even when large boxes are being formed.

A further object of the invention is to provide a box which, when fully assembled and with its lid removed, will have an upper edge free from securing means.

Still yet a further object of the invention is to provide a box which provides a secure but separable connection of an edge part of a first component to an adjacent edge part of a second component, in which the separability is simplified and in which any breakage of a connecting organ can be repaired easily by replacing the broken connecting organ.

Another object of the invention is to provide a box which permits a lid and a base to be sealed to the side components of the box in accordance with the objectives outlined above and in a simple fashion.

Another object of the invention is to provide a box in which the securing means do not contribute to the ingress of water and/or the accumulation of water, yet do not constitute a waterproof seal.

Another object of the invention is to provide a box in which the securing means may be specified only for the central parts of the components and may extend a certain distance towards the corners, in this way creating conditions permitting the fixing to the lid and the base of separately manufactured corners having dimensions usually exceeding the dimensions of the securing means.

A further object of the invention is to provide a box which may be used not only with removable side components, but which permits the securing means to be used between the base or the lid and between adjacent side components.

Still yet another object of the invention is to provide a box having a separate connecting organ which includes a stepped section enabling it to be brought more easily into interaction with corresponding securing means.

These and other objects and advantages of the present invention will become apparent from the detailed description that follows.

SUMMARY OF THE INVENTION

The present invention provides a method of manufacturing a box having a number of components capable of being connected together, in which, among other features, an edge part of one component is capable of being connected to an edge part of an adjacent component, and in which the connection is made by securing means of corresponding connecting means provided to produce the connection at each edge part. The method provides that each component (side components, base and/or lid) be cut to size and manufactured so as to have dimensions corresponding to a box having a predetermined volume when fully assembled. An edge part for interacting in a secure but separable fashion with an adjacent edge part is provided with a number of securing means for producing the connection.

The present invention provides a box in which the connecting means which are provided for a first edge part may be secured irrespective of the direction or position of the connecting means for an adjacent, second edge part, whereas the connecting means intended for the adjacent, second edge part may advantageously be secured irrespective of the direction or position of the connecting means for the first edge part by providing a plurality of raised portions defining the length of the securing means for the first part and a corresponding raised portion defining the securing means of the second part so that the holding means is receivable in the securing means of the first and second parts.

In accordance with the foregoing, a number of components preferably are arranged next to each other so that edge parts already provided with securing means may be brought into engagement with each other.

The invention proposes that securing means for each edge part be so arranged as to interact with a securing means on a adjacent edge part, the securing means being arranged to interact with each other.

The invention also provides the novel arrangement of a strip having first securing means that is secured to one edge part and second securing means separate from the first securing means of the first strip secured to an adjacent edge part. The second securing means may include discrete securing members positioned along the edge part. A separate connecting member may be provided for the purpose of connecting together corresponding connecting means.

The invention also provides an arrangement permitting the secure but separable connection of a first edge part for a first component with an adjacent edge part for a second component, with each of the edge parts being provided with a number of securing means for producing the connection. The arrangement may be utilized with advantage in the manufacture of a box.

The invention provides in this context that the connecting means for the one edge part and the connecting means for the second edge part be so executed in relation to each other as to exhibit, irrespective of their direction or positioning lengthwise along the respective edge parts, securing means which correspond to each other and are capable of interacting with each other.

A separate connecting organ is proposed for the purpose of interacting with securing means which correspond to each other, and only particular securing means for the one edge part are so arranged as to correspond to discrete securing means for the second edge part.

it is also proposed that the strips should be in the form of metal strips having embossed areas or stamped depressions to form projections or slots and having securing organs to secure the strip to the edge part.

The invention also proposes an arrangement which is used for the construction of a box or similar object, in which one side component is provided along one edge part with an edge strip having along its length a number of projections or slots arranged at a certain distance from each other, and in which a second side component is provided along one edge part with a number of projections or slots arranged at a certain distance from each other, and in which a connecting organ in the form of an angled plate or a wire or other suitable connecting device is so arranged as to connect together the corresponding projections or slots.

ADVANTAGES

The advantages which may be regarded as being associated with a method in accordance with the present invention include the manufacture of boxes in a simple fashion irrespective of whether these are standard boxes or specially ordered boxes.

An advantage of the arrangement in accordance with the present invention is that it provides first securing means which may be applied to an edge part and second securing means which may be applied to an adjacent edge part without having to take into account any corresponding holding means, since the holding means are so executed that, irrespective of their arrangement and position, corresponding securing means will be present at all times by providing a plurality of raised portions defining the length of the securing means for the first part and a corresponding raised portion defining the securing means of the second part so that the holding means is receivable in the securing means of the first and second parts.

BRIEF DESCRIPTION OF THE DRAWINGS

A preferred embodiment exhibiting the significant characteristics of the present invention is described below in greater detail with reference to the accompanying drawings, in which.

DESCRIPTION OF THE PREFERRED EMBODIMENTS

Figures 1, 2, 3, 4, 5, 6, 7, 8, 9:
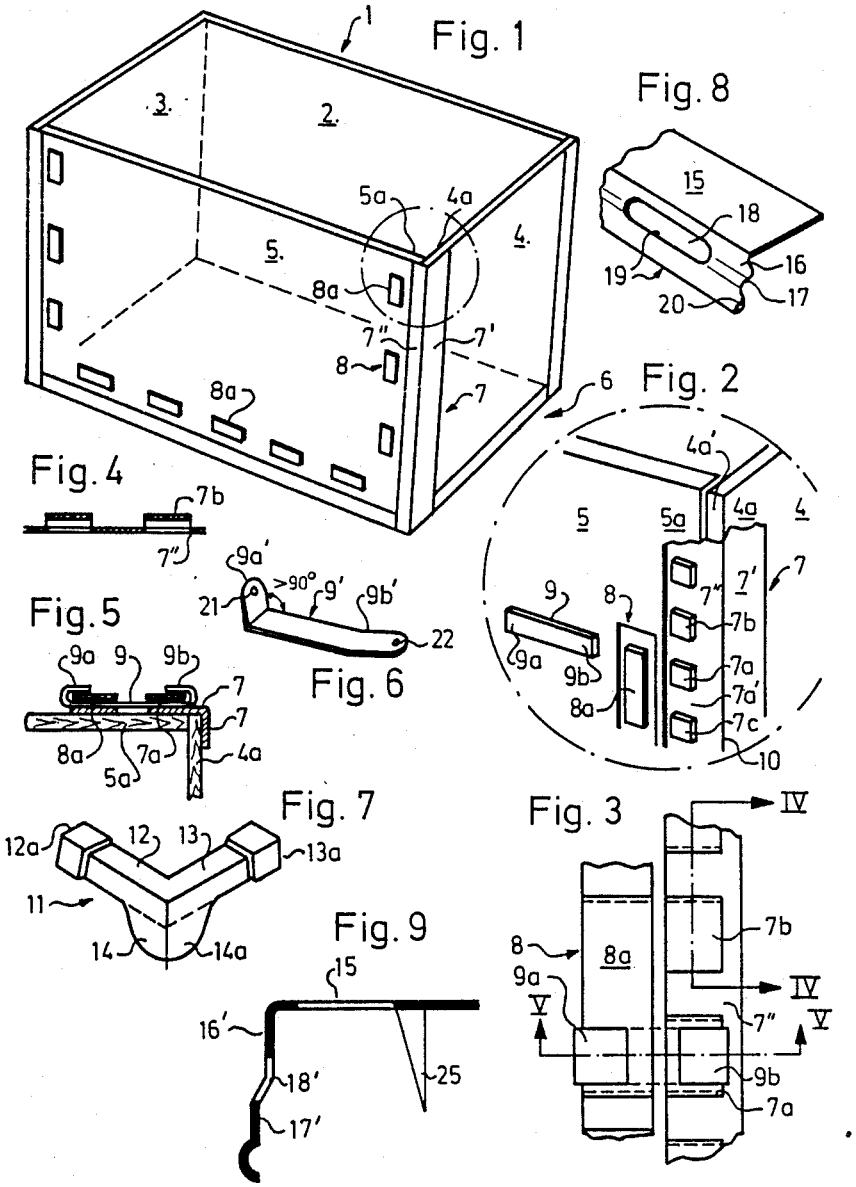
FIG. 1 is a prespective view of a box with its securing arrangement depicted schematically.
FIG. 2 is an enlarged view of a corner of the box in accordance with FIG. 1, with the securing arrangement shown in greater detail.
FIG. 3 is a front view of two securing means and a connecting organ, the organ interacting with corresponding securing means.
FIG. 4 is a sectional view along the line IV—IV in FIG. 3.
FIG. 5 is a sectional view along the line V—V in FIG. 3.
FIG. 6 is a perspective view of an alternative configuration of a connecting organ.
FIG. 7 is a separate corner fitting.
FIG. 8 depicts an alternative embodiment of a metal strip with securing means formed thereon.
FIG. 9 depicts another alternative embodiment of a metal strip with securing means formed thereon.

With reference to FIG. 1 is illustrated in perspective view a box 1, having four side components 2, 3, 4, and 5 and a base 6. the box 1 may very well be provided with a lid, the lid not being shown in FIG. 1, however.

The arrangement proposed in accordance with the invention permits the secure but separable connection of an edge part of a first component to an adjacent edge part of a second component.

In the interest of clarity, however, the following description will pertain only to the arrangement depicting the interaction between the side component 4 and the side component 5.

What is thus illustrated in FIGS. 1 and 2 is an arrangement permitting the secure but separable connection of an edge part 4*a* of the first side component 4 of the box to an adjacent edge part 5*a* of the second side component 5 of the box. Each edge part is provided with a number of connecting means for providing the connection. Connecting means 7 for one of the edge parts 4*a* and the corresponding connecting means 8 for the second edge part 5*a* are oriented relative to each other such that, irrespective of their direction or position lengthwise along the respective edge part, the edge parts 4*a*, 5*a* will have securing means which correspond to each other and which are capable of interacting with each other to provide a connection therebetween in a manner which is described below. These securing means are indicated at 7*a*–7*c* and 8*a* in FIG. 2 by providing securing means in the form of raised portions extending the length of the edge part 4*a* of the first side component 4 of the box and a corresponding securing means having a raised portion on the second edge part 5*a* so that the holding device 9 is receivable in the securing means of the first and second parts and thereby connecting the first and second side components 4, 5 of the box together.

A separate connecting organ 9 is so arranged as to be capable of interacting with the securing means 7*a*–7*c* and 8*a*. The connecting organ may be in the form of an angled plate which is adapted for insertion into corresponding securing means 7*a*, 8*a* arranged in the form of projections extending from the surfaces of the connecting means 7, 8.

With reference to FIG. 2, the securing means 7*a* rather than the securing means 7*b* provides a corresponding securing means for coupling with the securing means 8*a*. Therefore, only certain of the securing means 7*a*, 7*b*, 7*c* are so arranged as to correspond to the securing means 8*a* of the second edge part. The securing means 8*a* thus is in the form of separate members which are secured to the edge part 5*a*.

The securing means of the first edge part 4*a* will thus be in the form of a number of projections or slots arranged one after the other so as to form a strip. the strip is in the form of a metal strip with embossed areas or stamped depressions to form projections or slots, and with securing organs (not shown in the Figure) formed on the part 7′ so as to secure the connecting means or edge strip to the edge part 4*a*.

With reference to FIG. 2 it is clear, therefore, that a side component 4 is provided having an edge part 4*a* with an edge strip with is in turn provided along its length with a plurality of projections or slots arranged at a certain distance from each other, that a second side component 5 is provided having an edge part 5*a* with a plurality of projections or slots arranged at a certain distance from each other, and that a connecting organ in the form of an angled plate 9, which could be replaced by a wire or other suitable connecting device, connects corresponding projections to each other.

The connecting means 7 may be in the form of an ege strip which is bent in such a way that a first member 7′ is secured via securing organs not shown in the Figure to the edge part 4*a* of the side component and a second member 7″ angled with respect to the first member 7′ is so arranged as to extend beyond the end 4*a*′ of the side component and for a certain distance along the edge part 5*a* of an adjacent side component. The projections or the slots are formed in the second member 7″ a predetermined distance from the bend line 10.

FIG. 2 also shows that the projections 7*a*, 7*b* or the slots in the strip are so executed as to be of identical length and as to exhibit an identical distance between adjacent projections or slots. Corresponding projections or slots 8*a* have a length which is identical with or greater than the distance 7*a*′ between the projections 7*a*, 7*c* or the slots in the strip and are twice the width of the separate connecting organ 9.

The bent edge strip 7 can also be advanageously secured to a base and/or lid, when the connecting means 8 in the form of projections or slots 8*a* can be arranged along the side parts.

The projections or slots are also so arranged as to reduce or prevent the ingress of water. This may be achieved most easily by causing the slots on the component 7″ to be situated next to the end surface 4*a*′ but at a certain distance from the bend line 10. These requirements are particularly applicable to the base and the lid, in respect of which it is also preferable for adjacent edge parts to be straight.

With reference to FIG. 3, the arrangement depicted in FIG. 2 is illustrated in plan view in which the connecting organ 9 is shown to be bent around the securing means 7*a* and the securing means 8*a* in such a way that end parts 9*a* and 9*b* of the connecting organ 9 are situated above the securing means. FIG. 3 also shows that the securing means 8*a* can assume a position other than that illustrated in FIG. 2, but without jeopardizing the interaction between the securing means 7*a* and the securing means 8*a* via the connecting organ 9.

In the position the securing means 8*a* is provided in FIG. 2, the securing means can be brought into interaction with either the securing means 7*a* or 7*c*, whereas in the position given to the securing means 8*a* in FIG. 3 the connecting organ 9 is able to interact with either of the securing means 7*a* or 7*b*. In all other intermediate positions interaction is possible only between the securing means 7*a* and 8*a*. The significance of this arrangement for the securing means is that for every position to which the securing means 8*a* has been adjusted, it will always be so arranged as to interact with a corresponding securing means 7*a* or 7*b* or 7*c*.

FIG. 4 shows a section IV—IV in FIG. 3, the FIG. 5 shows a section V—V in FIG. 3. Similar components have been allocated similar reference designations.

With reference to FIG. 6, there is illustrated an alternative connecting organ 9' having a metal strip bent to a right angle at one end 9*a'* and bent through only a small angle at the other end 9*b'*. This arrangement permits the connecting organ 9' to be introduced in a simple fashion through the projection 8*a* and the projection 7*a* and permits the component 9*a'* to be bent over the projection 8*a* and the component 9*b'* over the projection 7*a*. The embodiment in accordance with FIG. 6 facilitates the introduction of the connecting organ and permits simple assembly of the box, since the connecting organ will, on being bent, force the projections 8*a* and 7*a* together, in so doing improving the holding together of the edge parts.

With reference to FIG. 7, there is illustrated a separate corner reinforcement 11 which is so arranged as to be capable of being secured either to the lid or to the base and to one or more of the corners of the box. This arrangement permits the corner reinforcement to be dimensioned more strongly than the metal edge strips, but the edge strips should not extend to the corners. A certain distance should remain near the corner, which distance corresponds substantially to the size of the corner reinforcement. The corner reinforcement 11 is provided with two arms 12, 13, the free ends 12*a* and 13*a* of which are provided with an overhanging part capable of enclosing one end of a metal strip. Also illustrated in FIG. 7 is the manner in which the corner fitting is provided with an additional tongue 14, 14*a*, although this tongue could, of course, be omitted.

Finally, with reference to FIG. 8, there is shown an alternative embodiment of a metal edge strip similar to the edge strip 7. This metal strip includes a flat edge 15 for securing to the side component 4 via securing organs not shown in the Figure and an angled component 16. The strip includes an angled member having a first component secured to the edge part 4*a* and a second component extending towards the adjacent edge part 5*a*. The second component includes an overhanging part 17 for forming a slot 19 to accommodate a depression 18 which provides the connection. The strip is bent through an angle of about 180° to provide reinforcement at the point indicated by the reference designation 20. This arrangement provides an opportunity to stack one or more lids or bases one on top of the other.

The embodiments described above illustrate with the greatest clarity that the number of connecting means 8 may be selected at will along an edge part, and that their number may be specified in relation to, among other consideration, the weight distribution and the size of the box.

It is also clear that the storage of finished side components is possible in a simple fashion in the absence of projecting flaps which can cause damage and which may themselves become damaged.

The construction is also so arranged that, even in the case of large boxes, the connecting organs may be brought simply into interaction with corresponding securing means. The securing means are also so executed as not to exhibit any component which extends beyond the upper edge part of the box.

In view of the fact that a separate connecting organ is used, it is also possible in a simple fashion to open the box for customs and similar inspections. If, however, the end parts of the connecting organ were to break off, a new connecting organ can be fitted simply.

The embodiment of the connecting organ in accordance with FIG. 6 can be provided with holes 21, 22, through which holes a wire for sealing the box may be passed, thus enabling the box to be sealed in a simple fashion.

The invention also provides a method of manufacturing a box having a number of components capable of being connected together, in which among other features, an edge part of one component is provided for connecting to an edge part of an adjacent component, the connection being effected by connecting means which securely connect each edge part. The adjacent components (side components and base and/or lid) are cut to size and manufactured, for example, from plywood, to a dimension corresponding to the expected volume of the box, and the edge part which is provided to interact in a secure but separable fashion with an adjacent edge part is provided with a number of connecting means for producing the connection.

The invention provides in particular that the securing means for a first edge part is secured irrespective of the expected direction or position of the securing means of the second, adjacent edge part, whereas the securing means of the second, adjacent edge part is secured irrespective of the expected direction or position of the securing means for the first edge part by providing the securing means of the first edge part as a plurality of raised portions and the securing means for the second edge part having a corresponding raised portion so that the holding device or element is receivable in the raised portions of the first and second securing means so as to connect the two sides of the box.

With the arrangement of the present invention discussed above, the connecting means 8 will be applied to the edge part in relation to the anticipated load and the side of the box, and not in relation to the connecting means present on the strip 7.

A number of components must accordingly be arranged next to each other in a previously disclosed fashion, in such a way that, among other features, edge parts provided with securing means are positioned next to each other.

The invention thus provides an arrangement wherein preferably each of the securing means for the edge part is arranged to interact with such securing means on an adjacent edge part as are found to correspond to each other.

The inventive method also provides that a strip having first securing means is secured to an edge part, and that other securing means separate from the first securing means on the strip is secured to an adjacent edge part.

The method also provides that a strip is bent to an angle, with one part of the strip being attached to the edge part and so arranged that its other part will cover and extend towards the end surface of the component. It has been found to be particularly desirable to have the second securing means to be in the form of discrete securing means positioned along the edge piece. The expression discrete securing means is used in this context to denote the presence of a certain distance between individual securing members situated next to each other, within which space no corresponding securing means are present.

The method provides further that a separate connecting organ be arranged for the purpose of connecting together corresponding securing means.

With reference to FIG. 9, there is shown an alternative embodiment of a metal strip similar to the metal strip 7. This metal strip includes a flat edge 15 for securing to the side component 4 by securing organs 25 and an angled component 16'. The strip includes an angled strip having a first member secured to the edge part 4 and a second member extending towards the adjacent edge part 5*a*. The second member includes an overhanging part 17'' for forming a slot to accommodate a depression 18' arranged to provide the connection.

The principles, preferred embodiment and modes of operation of the present invention have been described in the foregoing specification. The invention which is intended to be protected herein should not, however, be construed as being limited to the particluar forms disclosed, as these forms are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A box having a perimeter, said box permitting the secure but separable connection of a first edge part of a first component to an adjacent second edge part of the second component, each edge part having a longitudinal direction, said longitudinal direction being substantially perpendicular to the perimeter of said box, said first edge part having a plurality of first connection means, said second edge part having a plurality of second connection means, said connection means of said first and second edge parts each comprising projections extending from said edge parts, said projections having slots therethrough provided in a predetermined direction, said direction being the same as the direction of one of the first and second components extends in forming part of the perimeter of said box, the projections forming said first connection means aligned in a direction transverse to said predetermined direction and being a spaced distance apart, said slots of said projections forming said first connection means also having a linear dimension in a direction transverse to said predetermined direction and parallel to said longitudinal direction and of a size to accept a separate connector therethrough, said slots through said projections of said second connection means also extending in a direction transverse to said predetermined direction, the length of said slots forming said second connection means in said transverse direction being at least as long as the spaced distance between projections forming said first connection means including the length of a projection of said first connection means parallel to the length of said linear dimension, said first and second components being aligned at substantially right angles to each other with the longitudinal directions of the edge parts substantially parallel to each other, the slots of said projections of said first and second edge parts being arranged to extend parallel to each other with respect to said predetermined direction along said second edge part with at least all of one slot in the first edge part being aligned within the transverse direction of a slot of a projection of said second edge part for passage of said separate connector to secure the first and second components together so as to form said box.

2. The box in accordance with claim 1, wherein one of said first and said second edge parts is bent to form first and second members angled with respect to one another, the first member of said one edge part being attached by the separate connector to the other edge part and the second member extending beyond an end of the component to which said one edge part is associated for a predetermined distance.

3. The box in accordance with claim 1, wherein one of the edge parts is a separate strip attached to one of said components.

4. The box in accordance with claim 1, wherein the separate connector includes a metal strip bent to form a right angle at one end and bent through less of an angle at another end.

* * * * *